US008939286B2

(12) United States Patent
Hesse et al.

(10) Patent No.: US 8,939,286 B2
(45) Date of Patent: Jan. 27, 2015

(54) CONVERTIBLE PAINT BRUSH PACKAGE

(71) Applicant: Valspar Sourcing, Inc., Minneapolis, MN (US)

(72) Inventors: Bryan L. Hesse, Lake Bluff, IL (US); Jeffrey F. Taylor, Naperville, IL (US)

(73) Assignee: Valspar Sourcing, Inc., Minneapolis, MN (US)

( * ) Notice: Subject to any disclaimer, the term of this patent is extended or adjusted under 35 U.S.C. 154(b) by 0 days.

(21) Appl. No.: 13/974,599

(22) Filed: Aug. 23, 2013

(65) Prior Publication Data

US 2014/0061093 A1 Mar. 6, 2014

Related U.S. Application Data

(60) Provisional application No. 61/772,808, filed on Mar. 5, 2013, provisional application No. 61/694,418, filed on Aug. 29, 2012.

(51) Int. Cl.
*B44D 3/12* (2006.01)

(52) U.S. Cl.
CPC ..... *B44D 3/125* (2013.01); *Y10S 206/806* (2013.01)
USPC ..... 206/361; 206/362.4; 206/806

(58) Field of Classification Search
CPC .... A46B 17/04; B65D 73/0014; B65D 75/14; B44D 3/123; B44D 3/125
USPC ..... 206/774, 361, 362.4, 362.2, 362.3, 206/15.3, 495, 15.2, 806
See application file for complete search history.

(56) References Cited

U.S. PATENT DOCUMENTS

| | | | | |
|---|---|---|---|---|
| 1,931,293 | A | 10/1933 | Morck | |
| 1,938,442 | A | 12/1933 | Stuart | |
| 2,290,359 | A * | 7/1942 | Ringler | 206/362.4 |
| 2,506,821 | A * | 5/1950 | White | 206/362.4 |
| 2,506,954 | A | 5/1950 | First | |
| 2,562,482 | A | 7/1951 | Weisser | |
| 2,609,920 | A | 9/1952 | Ringler | |
| 2,763,367 | A | 9/1956 | Schumann | |
| 3,004,661 | A | 10/1961 | Schumann | |
| 3,035,693 | A | 5/1962 | Ehrler | |
| 3,055,492 | A | 9/1962 | Franklin et al. | |
| 3,419,132 | A | 12/1968 | O'Connell | |
| 3,765,044 | A * | 10/1973 | Hanahan et al. | 15/104.8 |
| 3,800,998 | A | 4/1974 | Gask | |
| 3,981,399 | A | 9/1976 | Crouch | |
| 4,207,977 | A | 6/1980 | Kronfeld et al. | |
| 4,606,456 | A * | 8/1986 | Kaminski | 206/362.4 |
| 4,826,006 | A | 5/1989 | Chainard | |
| D305,302 | S | 1/1990 | Beatrice et al. | |
| 5,191,973 | A | 3/1993 | Shteynberg | |
| D335,032 | S | 4/1993 | Durkin, III | |
| D350,234 | S | 9/1994 | Losole | |

(Continued)

FOREIGN PATENT DOCUMENTS

GB 2 232 950 A 6/1989

*Primary Examiner* — Steven A. Reynolds
(74) *Attorney, Agent, or Firm* — Mueting, Raasch & Gebhardt, P.A.

(57) ABSTRACT

A paint brush package apparatus, a packaged paint brush, and methods regarding the use of such paint brush packages, include a convertible package which may be converted from a display state (e.g., paint brush mounted on an elongate display panel of the package) to a protective state (e.g., after detaching the paint brush from the elongate display panel and for protective storage between uses).

15 Claims, 18 Drawing Sheets

(56) References Cited

U.S. PATENT DOCUMENTS

| | | | | |
|---|---|---|---|---|
| 5,363,959 | A * | 11/1994 | Crosby et al. | 206/362.4 |
| 5,465,453 | A | 11/1995 | Landmeier | |
| 5,566,820 | A | 10/1996 | Deaton | |
| 5,593,025 | A | 1/1997 | Feibelman | |
| 5,791,470 | A * | 8/1998 | Usui | 206/362.4 |
| 5,791,608 | A * | 8/1998 | Nielsen et al. | 248/110 |
| 6,199,694 | B1 | 3/2001 | Van Diest et al. | |
| 6,575,295 | B2 * | 6/2003 | Mayfield | 206/15.3 |
| 6,675,966 | B1 | 1/2004 | Ray | |
| D491,730 | S | 6/2004 | Goulet et al. | |
| 6,932,217 | B1 * | 8/2005 | Bailey | 206/362.4 |
| D510,813 | S | 10/2005 | Gilman | |
| 7,228,976 | B2 | 6/2007 | Pretorius | |
| 7,424,952 | B2 | 9/2008 | Antler | |
| 7,607,537 | B2 | 10/2009 | Katsuyama | |
| 8,074,796 | B1 | 12/2011 | Andrews | |
| D653,534 | S | 2/2012 | Shinn | |
| 2001/0047948 | A1 * | 12/2001 | Cummings et al. | 206/362.4 |
| 2003/0062280 | A1 * | 4/2003 | Davis | 206/362.4 |
| 2006/0000730 | A1 * | 1/2006 | Llano | 206/362.4 |
| 2007/0062829 | A1 * | 3/2007 | Crocker | 206/362.4 |
| 2009/0078602 | A1 * | 3/2009 | White | 206/361 |

* cited by examiner

CONVERTIBLE PAINT BRUSH PACKAGE

CROSS REFERENCE TO RELATED APPLICATIONS

This application claims the benefit of U.S. Provisional Application Ser. No. 61/772,808, filed 5 Mar. 2013, entitled "CONVERTIBLE PAINT BRUSH PACKAGE" and U.S. Provisional Application Ser. No. 61/694,418, filed 29 Aug. 2013, entitled "CONVERTIBLE PAINT BRUSH PACKAGE," both of which are incorporated herein by reference in their entirety.

BACKGROUND

The present disclosure herein relates generally to paint brushes. More particularly, the disclosure herein pertains to packages for paint brushes.

Paint brushes may be displayed in various ways. For example, paint brushes may be displayed by hanging the paint brush on a hook, either by a hole or hanging feature provided on the handle, or by a hanging feature included in the paint brush packaging. Alternatively, paint brushes are also stored in a lying down position (e.g., in a box).

Many paint brush package configurations incorporate features to protect the bristles from damage. Without a feature to protect the bristles from damage (e.g., during shipment, display, and between uses), the brush performance may be reduced.

Various techniques have been described to address the problems with protecting bristles. However, such techniques are inadequate for various reasons. For example, one or more of such techniques for packaging paint brushes in a display state involves a package that covers the brush bristles. However, this leads to the customer being unable to view the bristles before purchase without opening the package. One or more of such techniques may also involve a package that does not extend the full length of the brush (e.g., only covers the bristle and ferrule portion), thus limiting the surface area of the package for communicating graphics and/or text to the customer. Still other existing packaging techniques result in a package that is unable to be opened without destroying the package, thus making the package unsuitable for use with the brush at a later time.

SUMMARY

The disclosure herein relates generally to packaging for paint brushes, packaged paint brushes, and methods for making the same. Generally, the disclosure herein pertains to a package apparatus for paint brushes that is convertible between a display state and a protective state. For example, one or more embodiments described herein provide a package apparatus that maximizes packaging surface area for communication to the consumer at the point of purchase, while being convertible to a protective state for protecting the brush for storage after purchase and between uses.

One exemplary embodiment of a packaged paint brush described herein may include a paint brush and a convertible package (e.g., a package convertible from a display state to a protective state). The paint brush includes a handle and a plurality of filaments (e.g., bristles) terminating at a brush tip region. The convertible package may include an elongate display panel extending between a first end region and a second end region (e.g., the paint brush may be mounted thereon in a display state with the handle of the paint brush towards the first end region of the elongate display panel). The elongate display panel may include a tip holding portion at the second end region thereof to cover at least a portion of the plurality of filaments of the brush tip region. Further, the convertible paint brush package may include a fold region between the first and second end regions configured to allow the elongate display panel to be folded such that at least a portion of the first end region of the elongate display panel can be coupled near the second end region of the elongate display panel in a protective state to protect the paint brush (e.g., when the paint brush is removed from a display state mounted on the elongate display panel and then returned to the package to protect at least the brush tip region). Further, there may be provided one or more defined regions corresponding to one or more openings configured to receive therethrough the handle of the paint brush when in the protective state.

In one or more embodiments of the packaged paint brush, the paint brush may include a coupling apparatus to couple the handle to the plurality of filaments. In the display state, at least a portion of the coupling apparatus and at least a portion of the brush tip region are accessible.

Further, for example, in one or more embodiments of the packaged paint brush, a length of the elongate display panel from the first end region to a fold line in the fold region of the elongate display panel is substantially equal to or longer than a length from a handle-brush transition point between the handle and brush of the paint brush to the tip holding portion (e.g., the handle brush-transition point being located where the handle transitions into the brush portion of the paint brush).

Further, for example, in one or more embodiments of the packaged paint brush, the one or more defined regions configured for receiving the handle of the paint brush may include at least one defined removable region of the elongate display panel (e.g., the at least one defined removable region may include a perforated area or other type of area to be removed).

Further, for example, in one or more embodiments of the packaged paint brush, the tip holding portion may include a receptacle provided at the second end region of the elongate display panel to receive a portion of the first end region of the elongate display panel when in the protective state, and to receive the brush tip region of the paint brush in both the display state and in the protective state.

Further, for example, in one or more embodiments of the packaged paint brush, the receptacle may include one or more access openings to allow access to a portion of the brush tip region when received therein.

An exemplary package apparatus including a convertible package for a paint brush (e.g., a paint brush including a handle and a plurality of filaments terminating at a brush tip region) is also described. For example, the convertible package may include an elongate display panel extending between a first end region and a second end region and configured to mount a paint brush thereon in a display state with the handle of the paint brush towards the first end region thereof. The elongate display panel may include a tip holding portion at the second end region thereof to cover at least a portion of the plurality of filaments of the brush tip region when the paint brush is mounted on the elongate display panel. Further, a fold region between the first and second end regions may be provided to allow the elongate display panel to be folded such that at least a portion of the first end region of the elongate display panel can be coupled near the second end region of the elongate display panel in a protective state (e.g., to protect a paint brush that has been removed from a display state mounted on the elongate display panel and then returned to the package to protect at least the brush tip region). Further, one or more defined regions corresponding to one or more openings may be provided for receiving therethrough a handle of the paint brush when in the protective state.

Further, for example, in one or more embodiments of the paint brush package apparatus, the one or more defined regions configured for receiving a handle of the paint brush may include at least one defined removable region of the elongate display panel (e.g., the at least one defined removable region may include a perforated area or other type of removable area).

Further, for example, in one or more embodiments of the paint brush package apparatus, the one or more defined regions configured for receiving a handle of the paint brush may include an opening.

Further, for example, in one or more embodiments of the paint brush package apparatus, a fold region may be defined in a central portion of the elongate display panel between the first end region and second end region. The fold region may include one or more fold lines (e.g., living or pre-formed hinges) substantially orthogonal to an axis defined along a length of the elongate display panel.

Further, for example, in one or more embodiments of the paint brush package apparatus, the one or more defined regions corresponding to one or more openings for receiving a handle of the paint brush may be located between a first fold line and a second fold line of the one or more fold lines in the fold region. For example, the one or more fold lines may be substantially parallel to each other and orthogonal to the axis defined along the length of the elongate display panel.

Further, for example, in one or more embodiments of the paint brush package apparatus, the length from the first end region to the one or more fold lines may be substantially equal to the length from the second end region to the one or more fold lines.

Further, for example, in one or more embodiments of the paint brush package apparatus, the convertible package may include a closure apparatus to couple the first end region near the second end region of the elongate display panel when in the protective state (e.g., the closure apparatus may include at least one of hook and loop fasteners, magnets, tabs and slits, reusable adhesive, snaps, and/or string and button closures).

Further, for example, in one or more embodiments of the paint brush package apparatus, the second end region may include a receptacle to receive a portion of the first end region of the elongate display panel in the protective state and to receive the brush tip region of a brush in both the display state and in the protective state.

Further, for example, in one or more embodiments of the paint brush package apparatus, the receptacle may include one or more access opening to allow access to a portion of the brush tip region when received therein.

Further, for example, in one or more embodiments of the paint brush package apparatus, the elongate display panel may be provided such that substantially only the brush tip region of the paint brush is covered by one or more portions of the receptacle when mounted in the display state.

Further, for example, in one or more embodiments of the paint brush package apparatus, the convertible package may include one or more fixation elements (e.g., twist tie, tie strap, string, glue or adhesive, etc.) to mount a paint brush to the elongate display panel in the display state.

Further, for example, in one or more embodiments of the paint brush package apparatus, the convertible package may include a display mounting element (e.g., a hole in the elongate display panel or a hang tag attached to the elongate display panel to hang the package on a display rack or hook) associated with the first end region.

An exemplary method of using a paint brush package is also described. For example, the method may include: providing a packaged paint brush (e.g., wherein the paint brush may include a handle and a plurality of filaments terminating at a brush tip region, wherein the packaged paint brush may include an elongate display panel extending between a first end region and a second end region, and further wherein the paint brush may be mounted thereon in a display state with the handle toward the first end region); separating the paint brush from the elongate display panel; folding the elongate display panel at a fold region located between (e.g., generally midway between) the first end region and the second end region (e.g., wherein folding the elongate display panel may include moving at least a portion of the first end region of the elongate display panel towards the second end region of the elongate display panel); inserting the handle of the paint brush into one or more openings of the elongate display panel; placing the brush tip portion of the paint brush into a tip holding portion of the elongate display panel at the second end region thereof; coupling at least a portion of the first end region of the elongate display panel to at least a portion of the second end region of the display panel to provide the paint brush in a protective state.

In one or more embodiments of the method, the method may include one or more of the following: removing one or more defined regions of the elongate display panel to provide one or more openings through which the handle of the paint brush may be inserted; providing a tip holding portion in the form of a receptacle (e.g., a pocket or other receiving portion) at the second end region of the elongate display panel; and positioning at least a portion of the first end region into a receptacle along with a portion of the brush tip region to provide a paint brush in the protective state.

The above summary is not intended to describe each embodiment or every implementation of the present disclosure. A more complete understanding will become apparent and appreciated by referring to the following detailed description and claims taken in conjunction with the accompanying drawings.

DETAILED DESCRIPTION OF EXEMPLARY EMBODIMENTS

Figure 1:
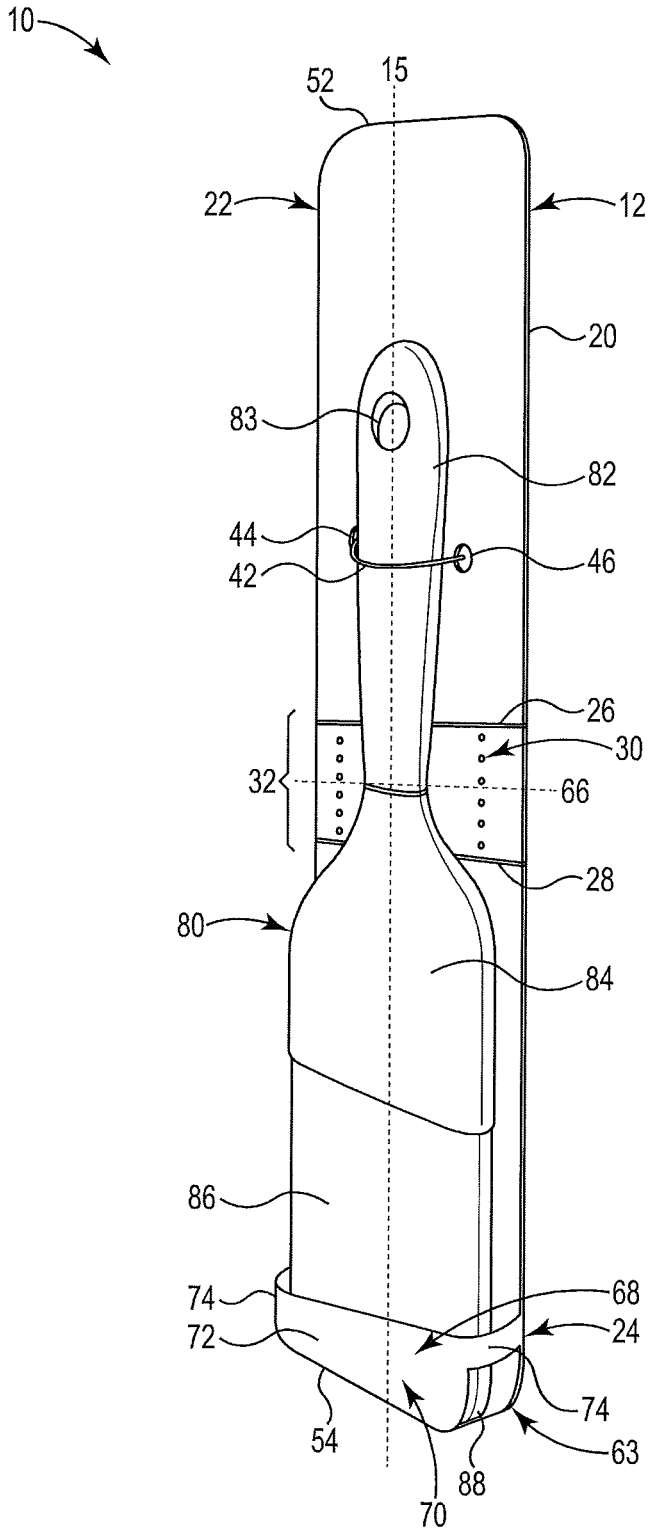
FIG. 1 is a front perspective view of an exemplary embodiment of a packaged paint brush in a display state.

In the following detailed description of illustrative embodiments, reference is made to the accompanying figures of the drawings which form a part hereof, and in which are shown, by way of illustration, specific embodiments which may be practiced. It is to be understood that other embodiments may be utilized and structural changes may be made without departing from (e.g., still falling within) the scope of the disclosure presented hereby.

Exemplary paint brush packages, packaged paint brushes, and methods regarding the same, for example, such as methods regarding the use of such paint brush packages (e.g., methods of converting the package from a display state to a protective state) shall generally be described with reference to FIGS. 1-18. It will be apparent to one skilled in the art that elements from one embodiment may be used in combination with elements of the other embodiments, and that the possible display and protective features of the embodiments using features set forth herein is not limited to the specific embodiments described. Further, it will be recognized that the embodiments described herein will include many elements that are not necessarily shown to scale. Further, it will be recognized that the size and shape of various elements herein may be modified without departing from the scope of the present disclosure, although one or more shapes and sizes may be advantageous over others.

FIGS. 1-4 show an exemplary embodiment of a packaged paint brush 10 including a package 12 (e.g., a convertible package) and a paint brush 80. The packaged paint brush 10 is shown in a display state (e.g., a state in which the paint brush may be displayed, such as, for example, hung on a rack, for sale and purchase). Although the term "display" is used to describe this configuration or state of the packaged paint brush, it will be recognized that this may be the state of the packaged paint brush available from the manufacturer, may be the state of the packaged paint brush received at a store prior to display, etc.).

The paint brush 80 may be of any configuration suitable for mounting in the package 12. For example, the paint brush 80 may include a handle 82 and a plurality of filaments 86 (e.g., bristles) terminating at a brush tip region 88. A coupling apparatus 84 (e.g., a ferrule) may be provided to join the handle 82 of brush 80 to the plurality of filaments 86 of the paint brush 80. A hole 83 for hanging the paint brush 80 may be located in the handle 82. The paint brush 80 may be of any suitable size or shape, one or more portions of the paint brush may be made of materials different than other portions, the coupling apparatus 84 may define a transition region of the handle 82 to the filaments 86, the paint brush may be defined along an axis (e.g., that may or may not be parallel to the axis of the package 12 on which it is mounted), the brush handle 82 may extend from a first end coupled by a ferrule to the filaments 86 of the paint brush 80 to a second distal end opposite the first end, and the filaments 86 may extend from a first end coupled to the handle 82 by the coupling apparatus 84 (e.g., ferrule) to a brush tip region 88 terminating the filaments opposite the first end thereof.

The package 12 may include an elongate display panel 20 extending along elongate axis 15 from a first end 52 to a second end 54. The elongate display panel 20 may include a fold region 32 including one or more fold lines (e.g., preformed hinges, living hinges, etc.), such as fold lines 26 and 28 defined along a fold axis 66 that may be substantially orthogonal to elongate axis 15. In such an exemplary configuration, fold lines 26 and 28 are defined such that at least a portion of a first end region 22 of the elongate display panel located towards the first end 52 can be coupled near a second end region 24 of the elongate display panel 20 located towards the second end 54 when converted from a display state (e.g., a display state being present when the paint brush 80 is mounted on the display panel 20 as shown in FIGS. 1-4) to a protective state (e.g., a protective state being present when the paint brush 80 is detached from the display panel 20 and the package is converted for protective storage of the paint brush 80 between uses as shown, for example, in FIG. 6).

Figure 5:
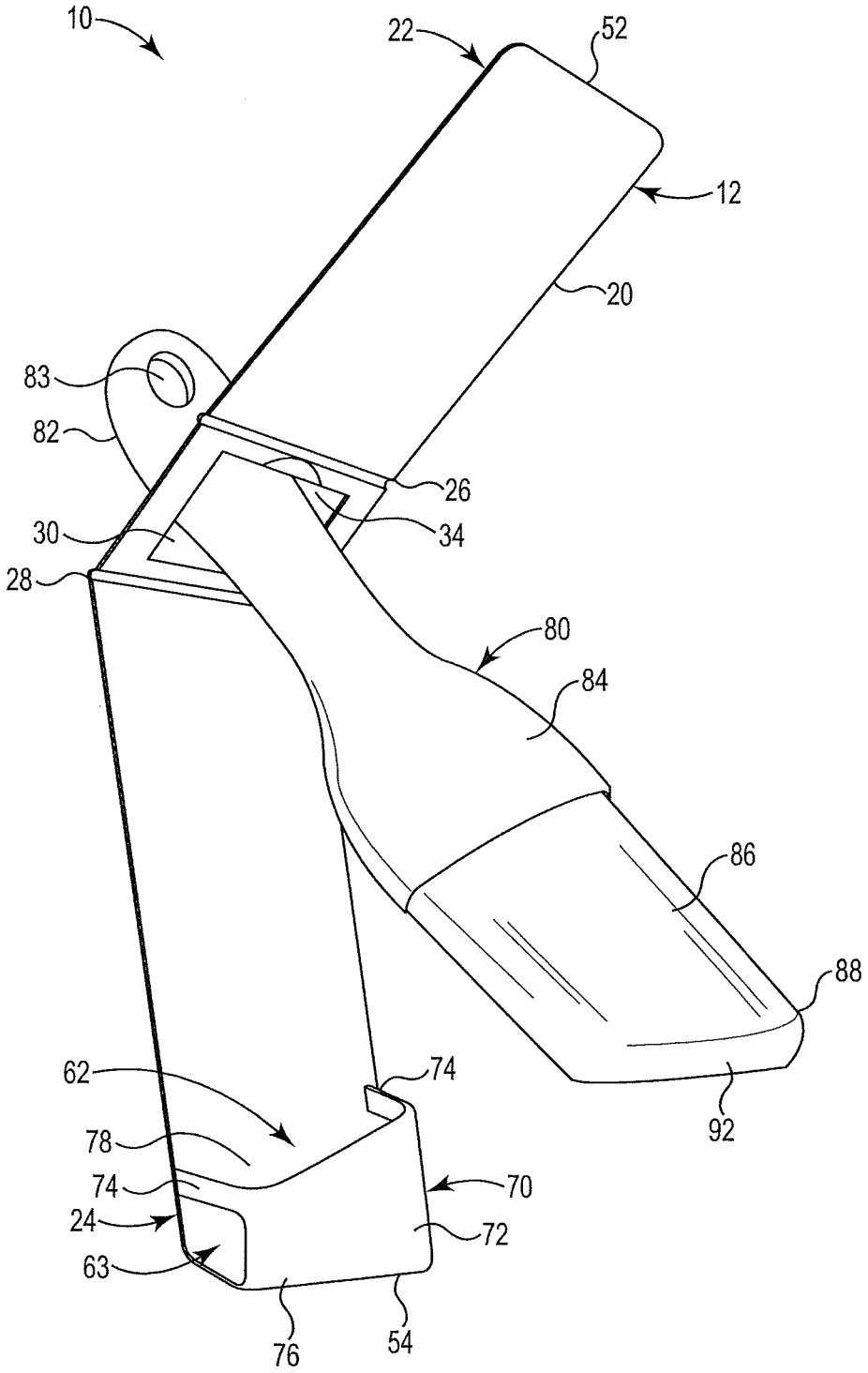
FIG. 5 is a front perspective view of the paint brush detached from the package, such as that shown in FIG. 1, in transition from a display state to a protective state.
Figure 6:
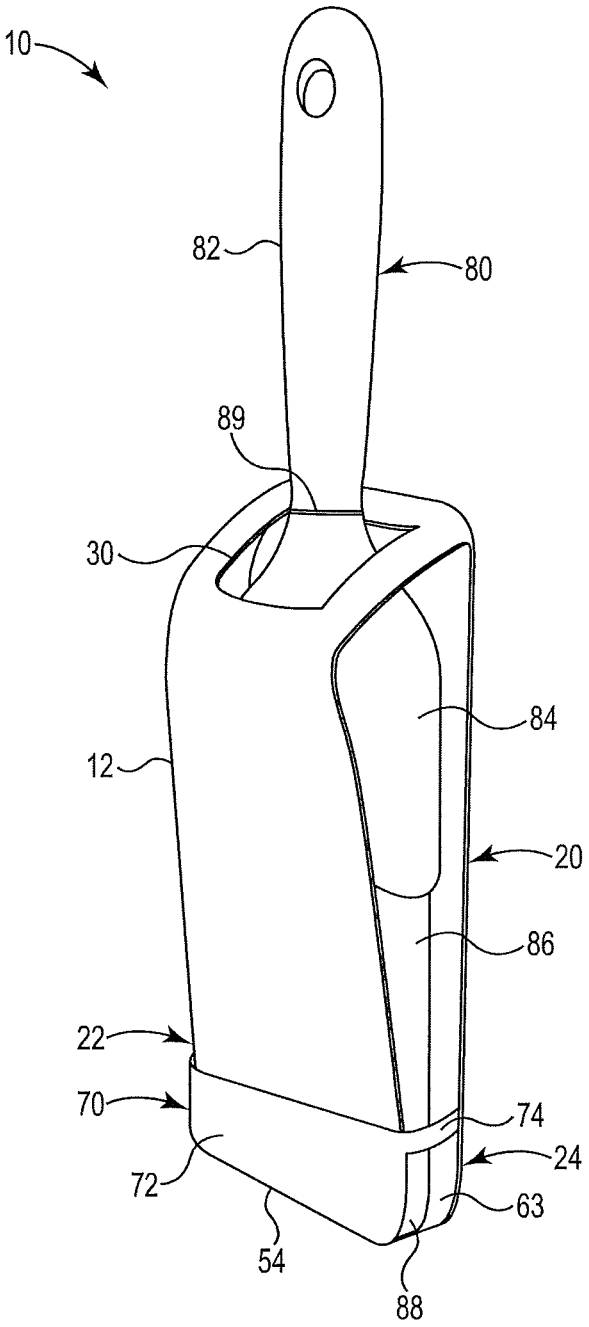
FIG. 6 is a front perspective view of the paint brush of FIG. 1 inserted into to the converted package in the protective state.

In one exemplary embodiment, the elongate display panel 20 may include one or more defined regions 30 corresponding to one or more openings 34 for receiving the handle 82 (e.g., see FIG. 5) of the paint brush 80 when the paint brush package is converted from a display state (e.g., present when the paint brush 80 is mounted on the display panel 20 as shown in FIGS. 1-4) to a protective state (e.g., after detaching the paint brush 80 from the display panel 20, and repositioned in a converted package for protective storage thereof between uses as shown in FIG. 6). The one or more defined regions 30 may be an opening or hole in the elongate display panel 20 (e.g., such as opening 34), or may be a removable portion as described herein (e.g., a perforated region usable to create an opening). Further, the one or more regions may be formed in any shape or size, such as, for example, to be complimentary to receiving the handle 82 of paint brush 80 (e.g., a rectangle (with or without rounded edges), a circle, ellipse, triangle, diamond, star, symmetric form, irregular form, or any other shape).

For example, the defined region 30 may be formed as a removable portion 31 of the elongate display panel 20 (e.g., to be removed or partially removed after purchase). When the defined region 30 is formed as a removable portion 31, the removable portion 31 may include a perforated area to be punched out (e.g., to form an opening for insertion of the handle 82) or partially punched out (e.g., separate 3 of 4 sides, creating a tab style opening) by a user (e.g., a consumer after purchase). The removable portion 31 of defined region 30 could also be configured as a removable sticker placed over an opening (e.g., including a sticker in the form of a removable coupon or other offer), some type of promotional material or product that is separable from the package, or other movable or removable feature.

In one or more embodiments, one or more of the fold lines (26, 28) may pass through or be located in or proximate to the defined region 30. For example, one or more fold lines may bisect the defined region 30 (e.g., may lie along the fold axis passing through the defined region). Further, for example, each (or just one) of the fold lines may be adjacent to or lie along one edge of the defined region 30, or lie outside the boundary of the defined region 30. For example, as shown in FIGS. 1-4, the defined region 30 may include a rectangular perforated removable portion having upper and lower edges parallel to the fold axis 66. Each of the fold lines 26, 28 may be adjacent to or lie along such edges of the defined region 30, or lie outside the boundary of the defined region 30 (e.g., parallel to the edges and/or parallel to the fold axis 66).

In one or more exemplary embodiments, the elongate display panel 20 may include a tip holding portion 70 at the second end region 24. The tip holding portion 70 may be used to cover at least a portion of the plurality of filaments 86 of the brush tip region 88 (e.g., see brush tip region 88 in FIG. 5) and/or allow access to one or more portions of the plurality of filaments.

For example, the tip holding portion 70 may protect the brush tip region 88 of paint brush 80 in both the display state (e.g., FIGS. 1-4) and the protective state (e.g., FIG. 6) (e.g., the brush tip region 88 is inserted into the tip holding portion 70 in both states). The tip holding portion 70 may be of any suitable configuration for receiving at least the brush tip region 88 (e.g., and possibly other portions of the filaments 92). For example, the tip holding portion 70 may take the form of a receptacle or pocket sized as a function of the brush tip region 88. As shown in FIGS. 1-4, one exemplary tip holding portion 70 may include a rear surface 78 (e.g., provided integral with another portion of the display panel 20 extending to the first end 52 thereof), a front surface 72 (e.g., that lies parallel to the rear surface 78), a bottom surface 76 extending between the front and rear surfaces 72, 78, and one or more side surfaces 74; wherein the surface define an opening and/or volume into which the brush tip region 88 may be inserted.

In one or more embodiments, the tip holding portion 70 may include one or more access openings 63 to allow the customer to view and/or feel at least a portion of the brush tip region 88 and/or the end of the plurality of filaments 92 when the brush tip region 88 is received in the tip holding portion 70. In one or more embodiments, for example, when in the display state, at least a portion of the coupling apparatus 84 of paint brush 80 (e.g., a ferrule or other feature which joins the handle to the bristles) and at least a portion of the brush tip region 88 are accessible. Further, in one or more embodiments, a portion of the plurality of filaments 92, other than the brush tip region 88 may also be accessible (e.g., the portion of the filaments located adjacent the coupling apparatus 84.

The one or more access openings 63 that may be present in the tip holding portion 70 may be defined at any location or through any surface of the tip holding portion 70. For example, access openings 63 may be formed in one or more of the side surfaces 74 of tip holding portion 70 that lie generally perpendicular to elongate display panel 20 (as shown in FIGS. 5 and 6). Further, for example, access openings 63 may be defined in any surface of the tip holding portion (e.g., front surface 72 of the tip holding portion 70 that lies parallel to the elongate display panel 20 (for example, access opening 163 in FIG. 11), the bottom surface 76 of the tip holding portion 70, or rear surface 78 of the tip holding portion).

In one or more embodiments of the packaged paint brush 10, paint brush 80 may be mounted to the package 12 such that the handle 82 may be located near the first end 52 of the elongate display panel 20 and the plurality of filaments 86 (e.g., bristles) terminating at a brush tip region 88 may be located near the second end 54 of the elongate display panel 20. The paint brush may be oriented along elongate axis 15 when mounted to the elongate display panel 20 in the display state. It will be recognized that although paint brush 80 may be substantially oriented along elongate axis 15 when in the display state, the handle 82 and the plurality of filaments 86, and components thereof, need not be centered or symmetrical with respect to axis 15. For example, handle 82 may include a coupling apparatus 84 attached to the plurality of filaments 86 (e.g., bristles) such that it is symmetric to the axis 15, but include a handle portion that is not centered or symmetrical on the axis 15.

Figure 2:
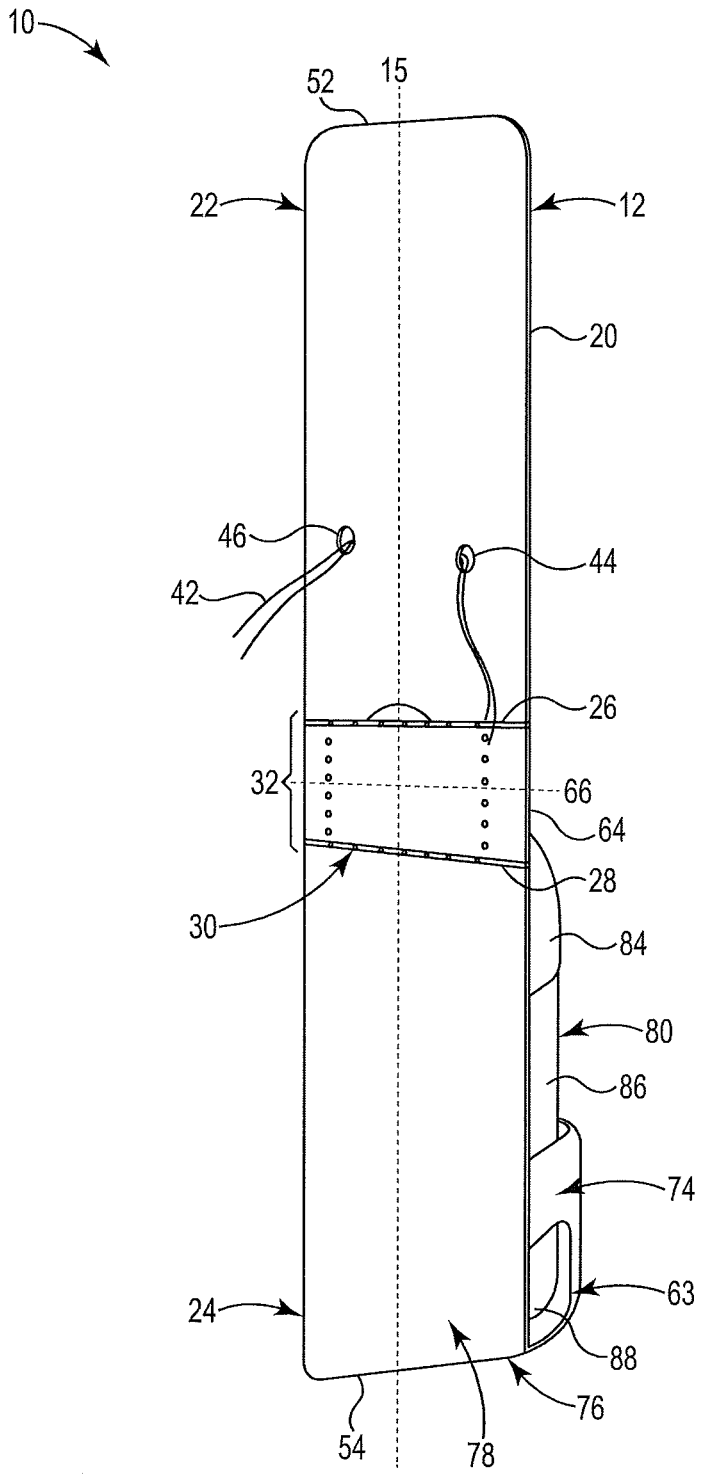
FIG. 2 is a rear perspective view of the packaged paint brush shown in FIG. 1.
Figure 3:
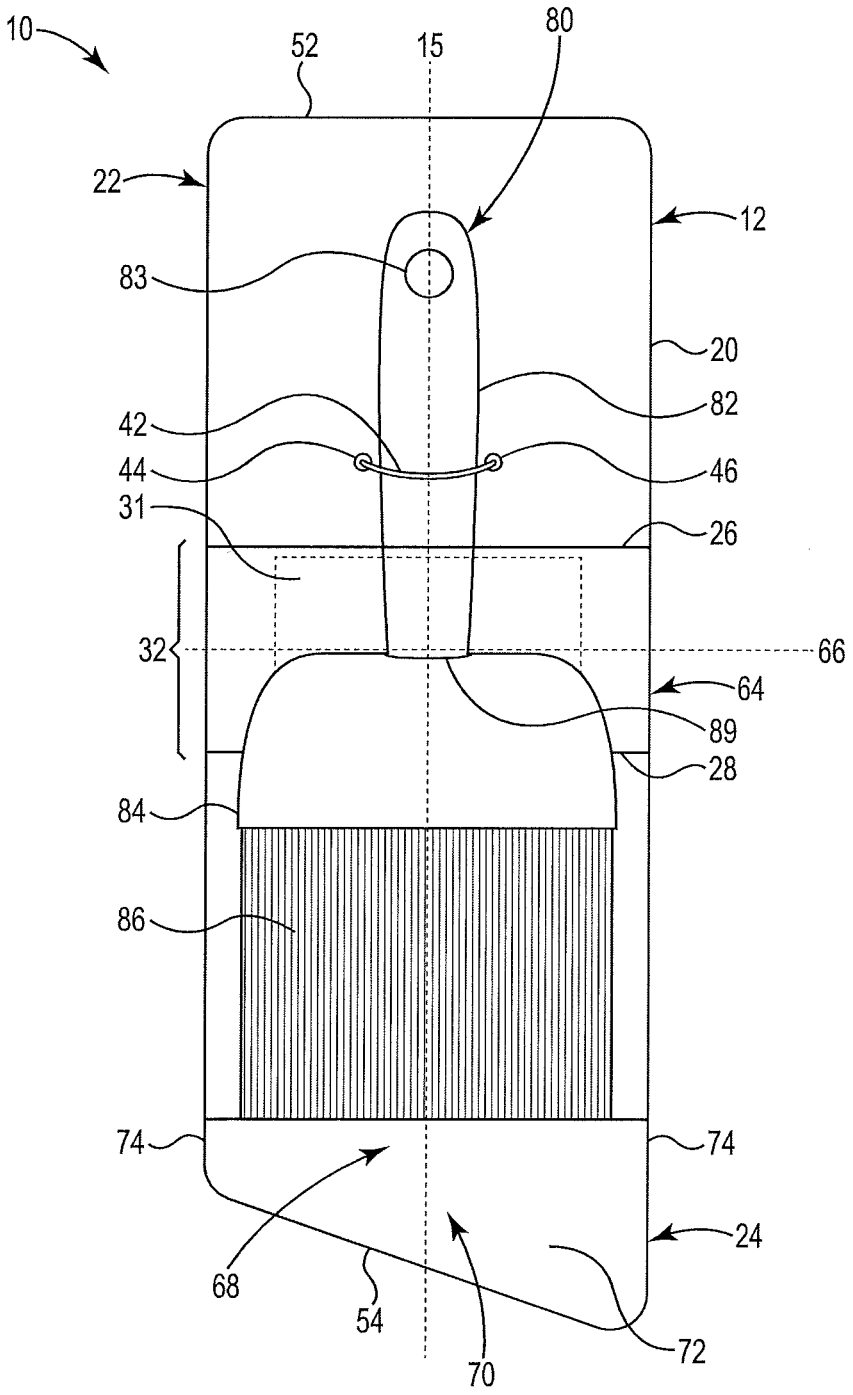
FIG. 3 is a front view of the packaged paint brush shown in the display state of FIG. 1.

Generally, paint brush 80 may be attached to elongate display panel 20 in the display state using any suitable fixation element, such as wrapping twist tie 42 around handle 82 and through attachment holes 44 and 46 of elongate display panel 20 to secure the paint brush to the elongate display panel 20 (as shown in FIGS. 1 and 2). For example, the fixation element may include one or more other attachment features such as tie straps, string, elastic, adhesive, glue, or any other attachment element or elements.

Figure 10:
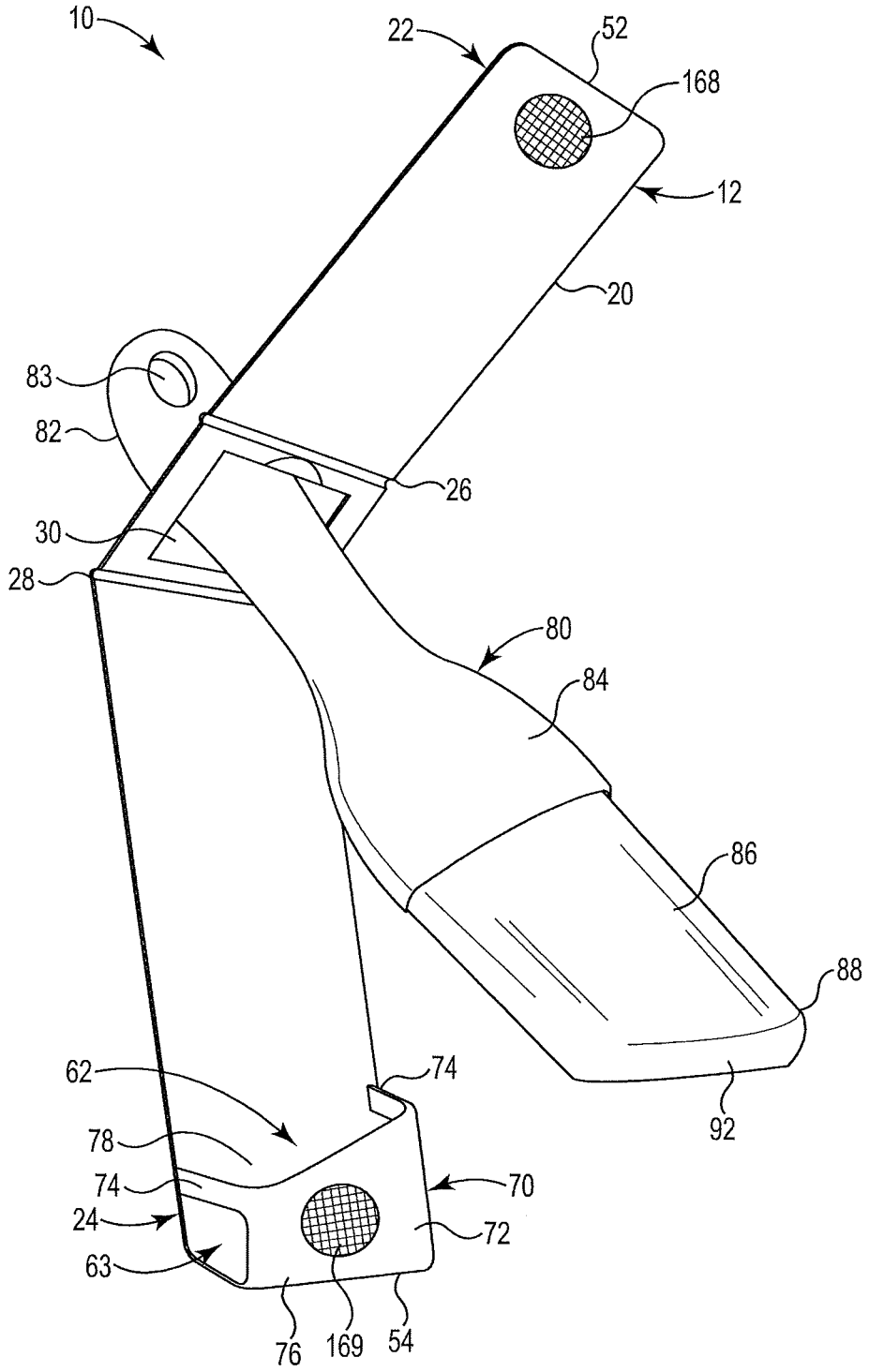
FIG. 10 is a front perspective view of another embodiment of a packaged paint brush incorporating an alternate closure feature.

The packaged paint brush 10 may include features allowing the package 12 to be converted from a display state (as shown, for example, in FIGS. 1-4) to a protective state (as shown, for example, in FIG. 6). When in the protective state, a closure apparatus 68 may be used to retain the package 12 in such a state. For example, any effective closure apparatus may be used, such as, for example, hook and loop fasteners, magnets, tabs and slits, reusable adhesive, snaps, string and button closure or any other coupling method or features. For example, as shown in FIG. 10, in one or more embodiments, the first and second end regions 22, 24 can be coupled by an alternative closure apparatus 168 and 169, including at least one of hook and loop fasteners, magnets, tabs and slits, reusable adhesive, snaps, string and button closure or any other coupling method.

Figure 16:
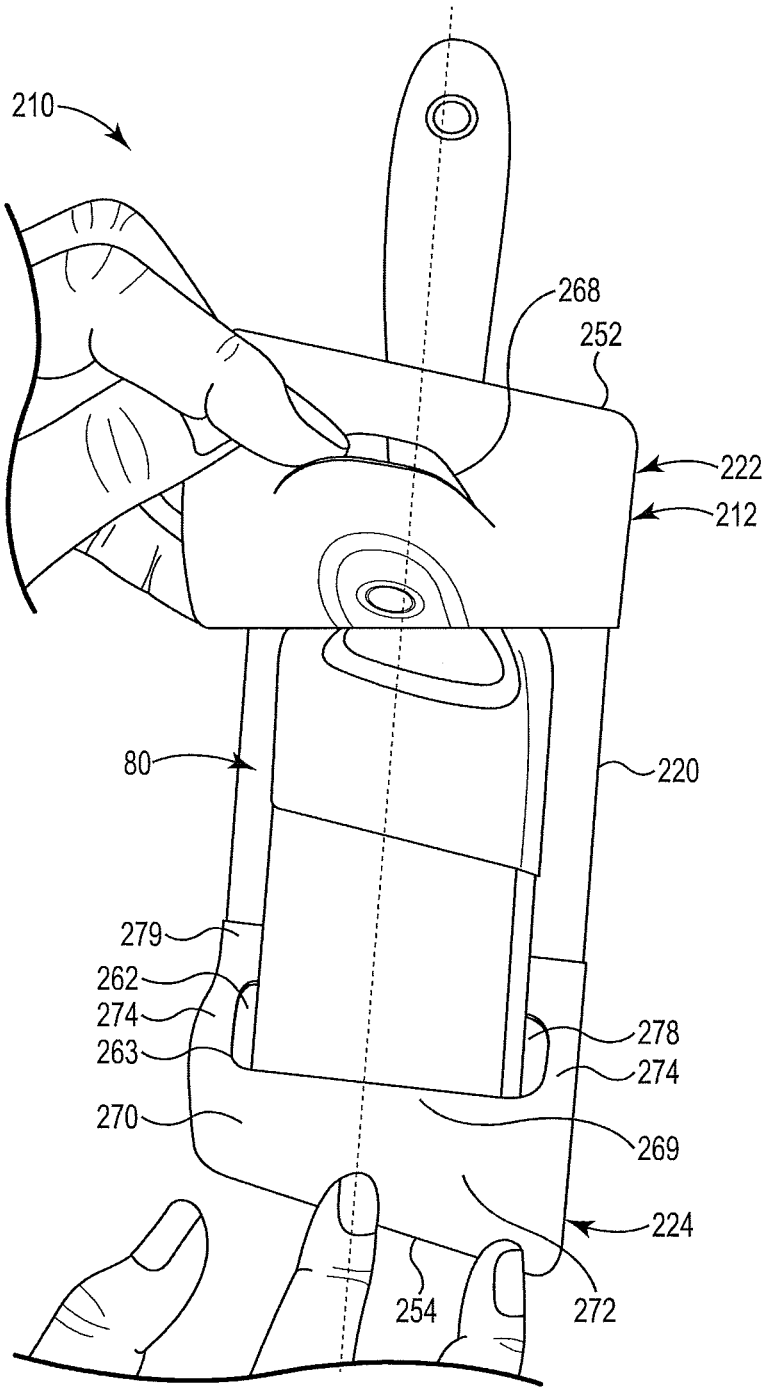
FIG. 16. is a front perspective view of another exemplary embodiment of a paint brush detached from the package, in transition from a display state to a protective state.
Figure 17:
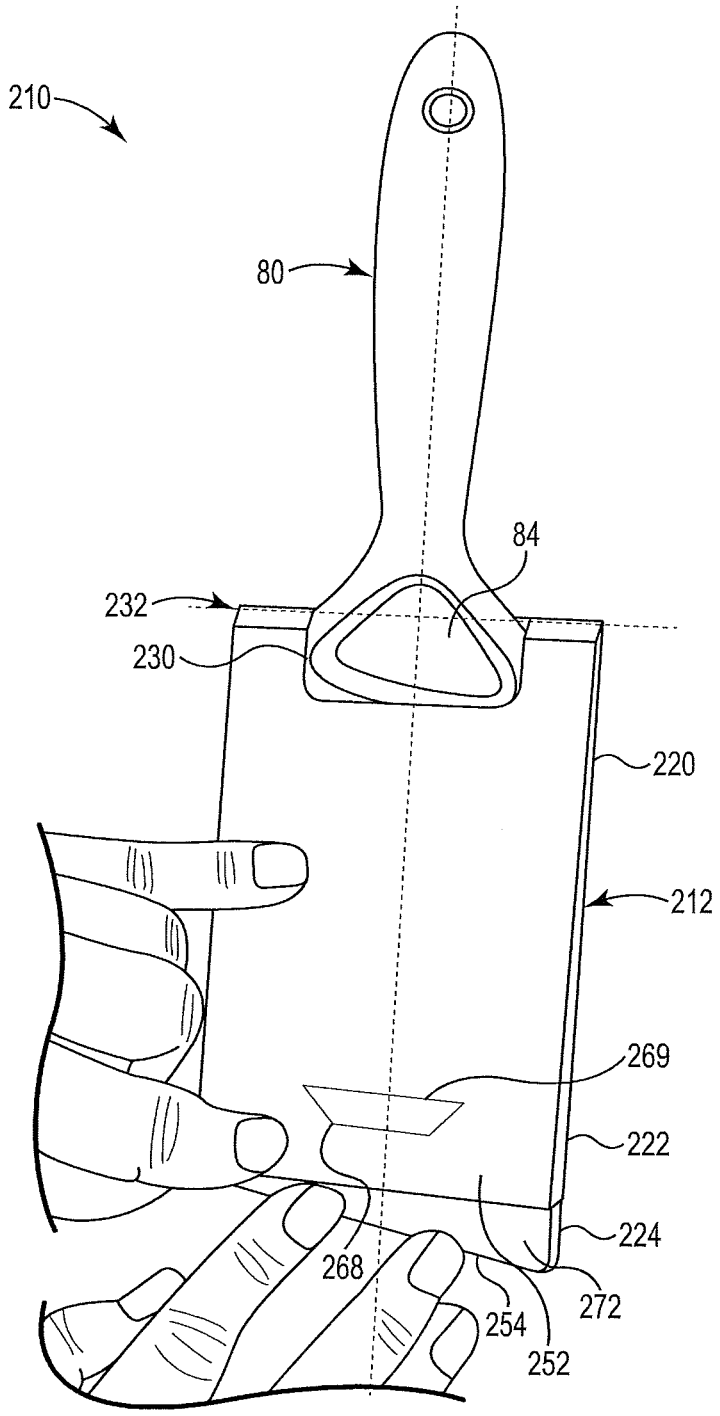
FIG. 17. is a front perspective view of the exemplary embodiment of FIG. 16. of a paint brush inserted into the converted package in the protective state.
Figure 18:
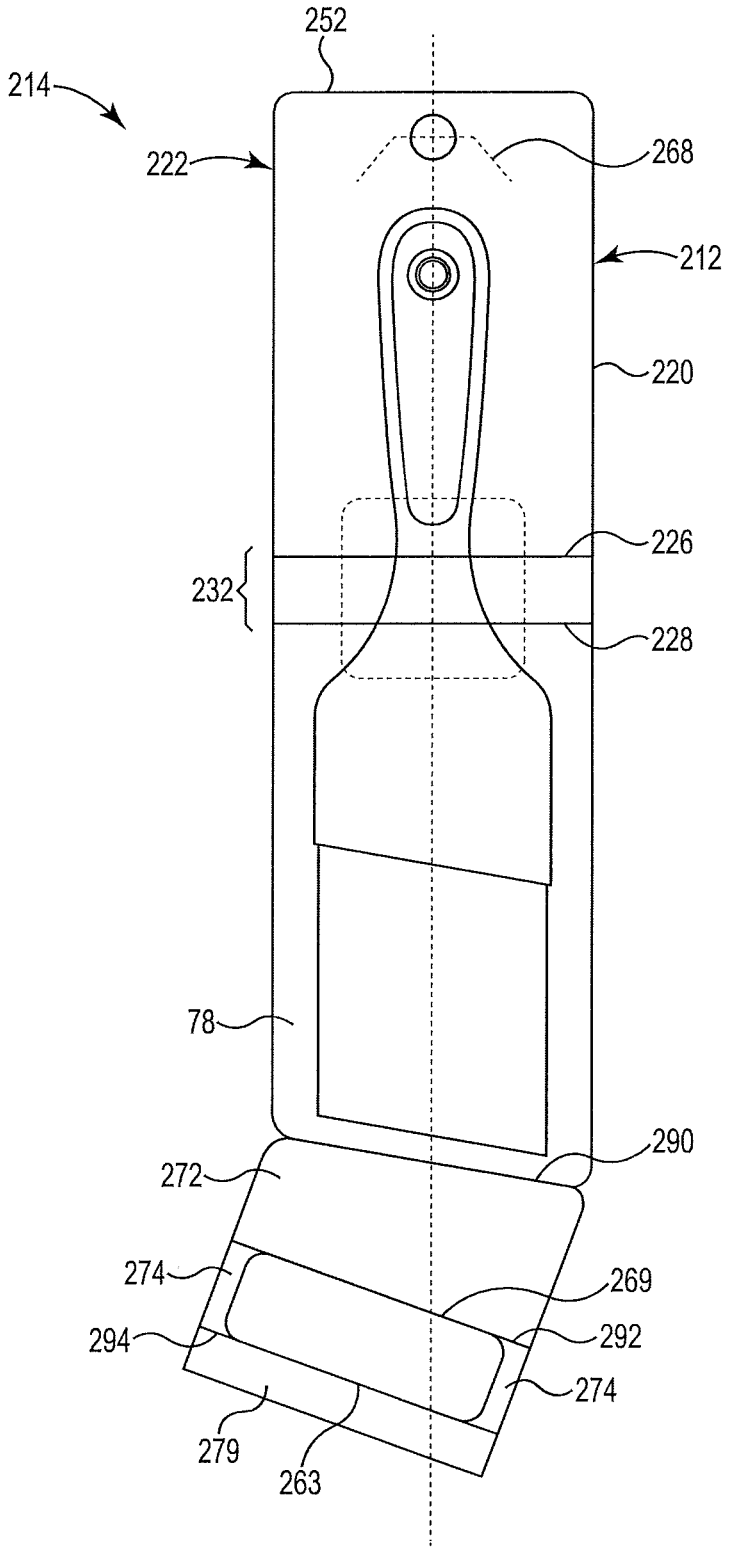
FIG. 18 is a plan view of the exemplary embodiment of a "blank" (e.g., a flat die cut of the package) for providing a package such as shown in FIG. 16.

Referring to FIGS. 5 and 6, in one exemplary embodiment of a packaged paint brush, for example, the tip holding portion 70 may also function to serve as the closure apparatus 68 for coupling the first end region 22 to the second end region 24 when in the protective state of FIG. 6. The tip holding portion 70 at the second end region 24 of elongate display panel 20 may form a receptacle 62 (e.g., see FIG. 5) to receive not only the brush tip region 88 (as shown in the display state of FIGS. 1-4) but also a portion of the first end region 22 of the elongate display panel 20 when in the protective state (see, e.g., the first end 52 of the display panel 20 tucked into the receptacle 62 with the brush tip region 88 as shown in FIG. 6), thereby coupling the first and second end regions 22 and 24, respectively (e.g., maintaining the package 12 in the protective state). Further, for example, as shown in FIG. 16-18, the closure apparatus 68 may be provided in the form of a tab 268 formed in the first end region 22 of elongate display panel 20, and a receiving edge 269 being provided at the second end region 24 of the elongate display panel 20.

Figure 4:
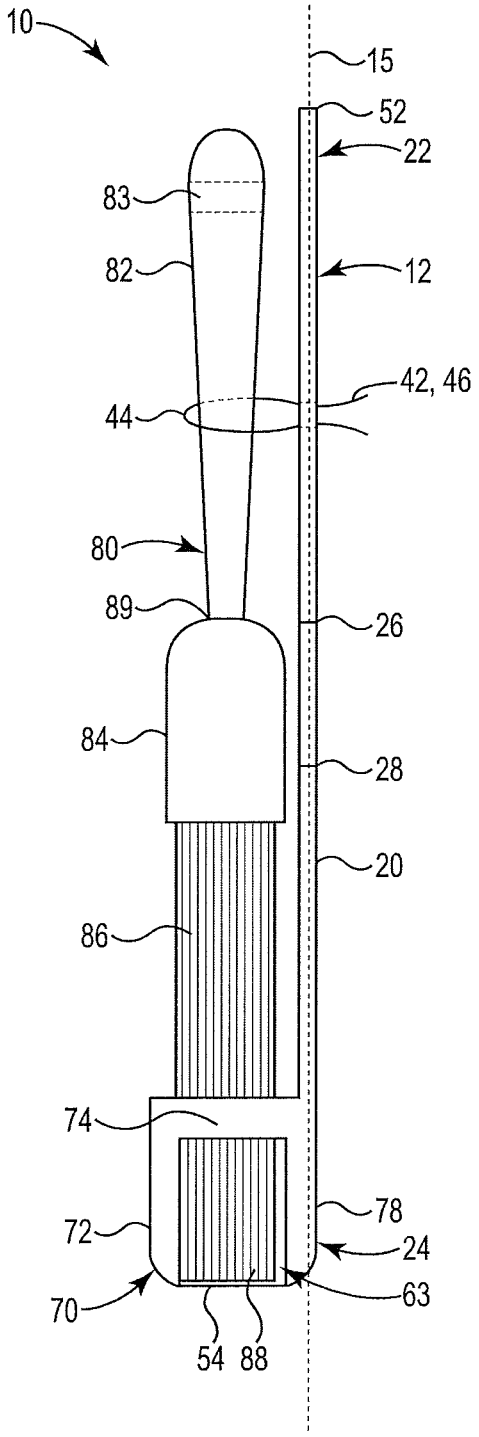
FIG. 4 is a side view of the packaged paint brush shown in the display state of FIG. 1.
Figure 7:
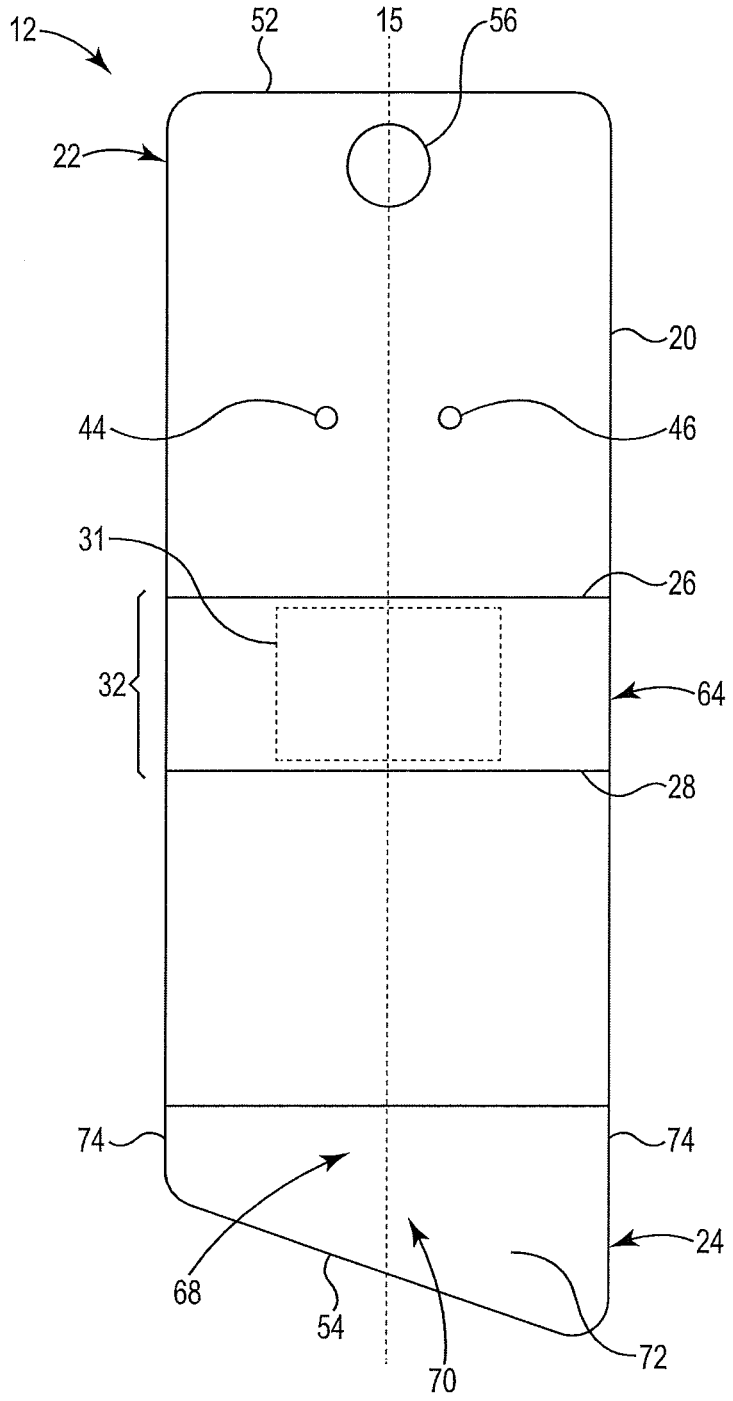
FIG. 7 is a front view of the paint brush package of FIG. 1 in the display state.
Figure 8:
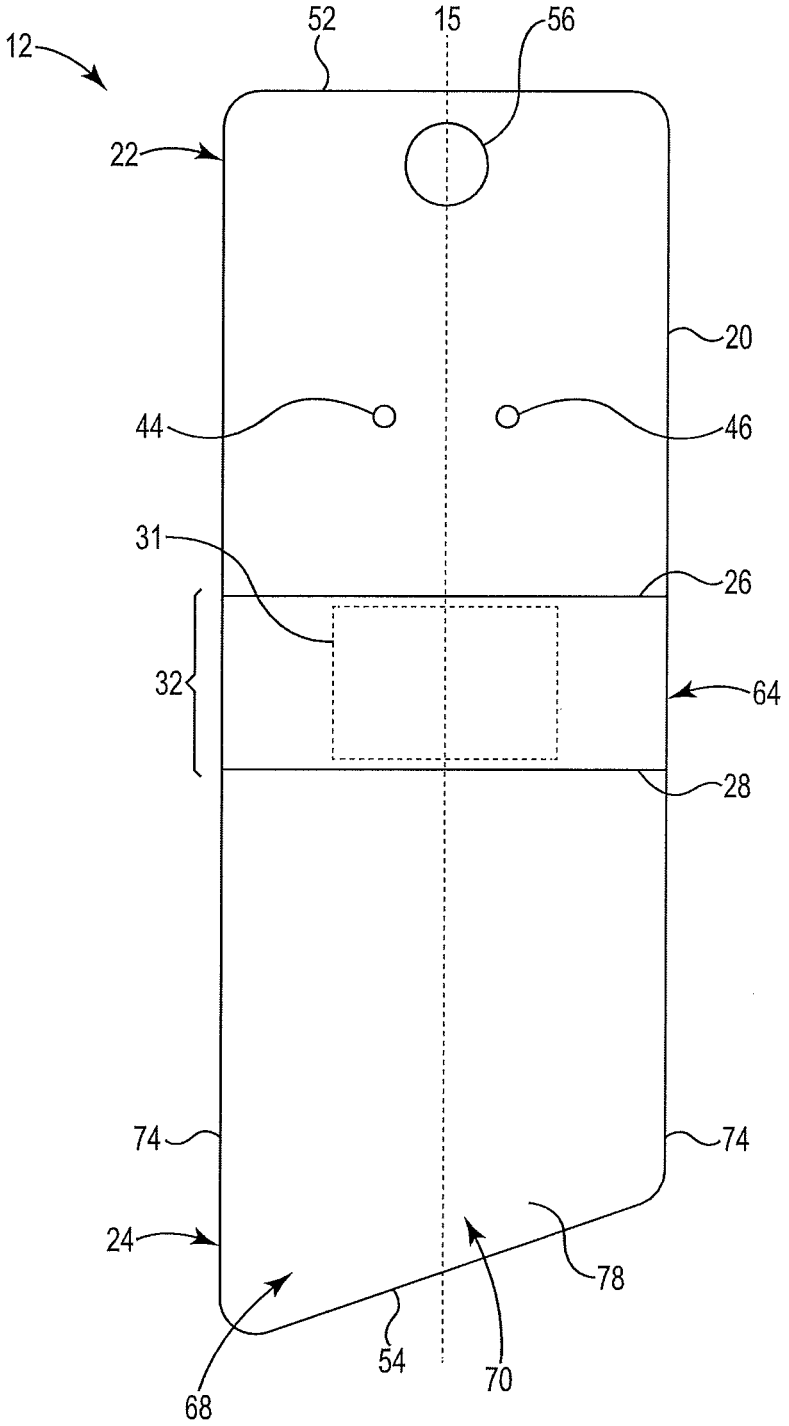
FIG. 8 is a rear view of the paint brush package of FIG. 1 in the display state.
Figure 9:
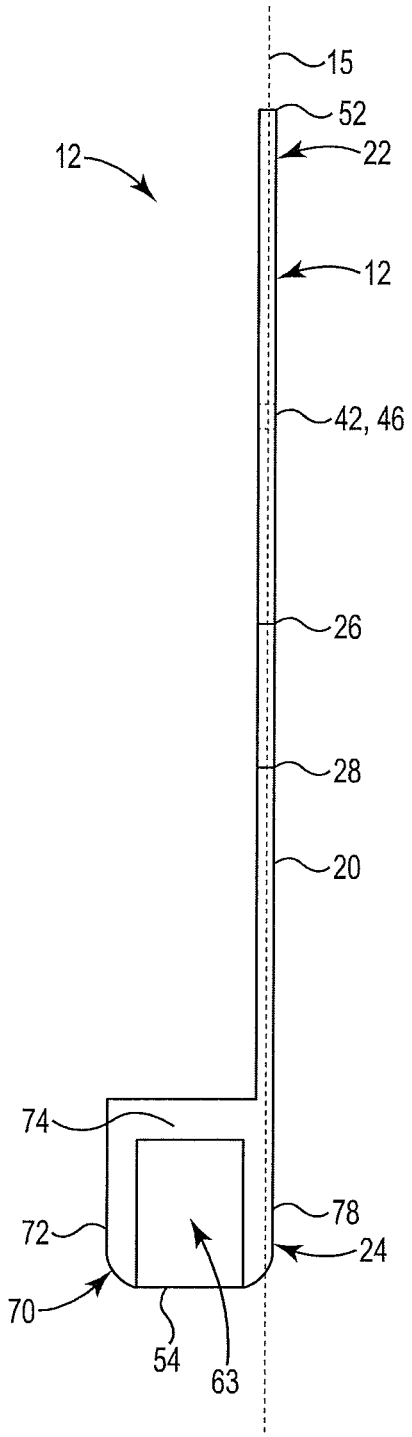
FIG. 9 is a side view of the paint brush package of FIG. 1 in the display state.

FIGS. 7-9 are front, back and side views of the elongate display 20 in the display state (e.g., FIGS. 1, 2 and 4 with paint brush 80 removed). Generally, the elongate display panel 20 of FIGS. 7-9 incorporates all of the features of the elongate display panel 20 as described with reference to FIGS. 1-6, but with the paint brush 80 removed from the package 12.

As shown in FIGS. 7-9, in one or more embodiments, for example, a length of the elongate display panel 20 from the first end region 22 to a fold line (26 or 28) in the fold region (32) of the elongate display panel 20 may be substantially equal to or longer than a length from a handle-brush transition point 89 to the brush tip region 88 of the paint brush 80.

Further, in one or more embodiments, for example, a length of the elongate display panel 20 from the second end region 24 to a fold line (26 or 28) in the fold region (32) of the elongate display panel 20 may be substantially equal to or longer than a length from a handle-brush transition point 89 to the brush tip region 88 of the paint brush 80.

In one or more embodiments, the elongate display panel 20 may include a display mounting element 56 generally associated with the first end region 22 (e.g., a hole in the elongate display panel 20, or a hang tag attached to the elongate display panel 20) to hang the packaged paint brush 10 on a display rack or hook. The display mounting element 56 may be located anywhere, and be of any shape or configuration enabling display of the packaged brush 10. Further, the display mounting element 56 may or may not be aligned with brush hole 83 (e.g., see brush hole 83 in FIG. 1 or 3) when the brush 80 is mounted on elongate display panel 20 in the display state.

Figure 11:
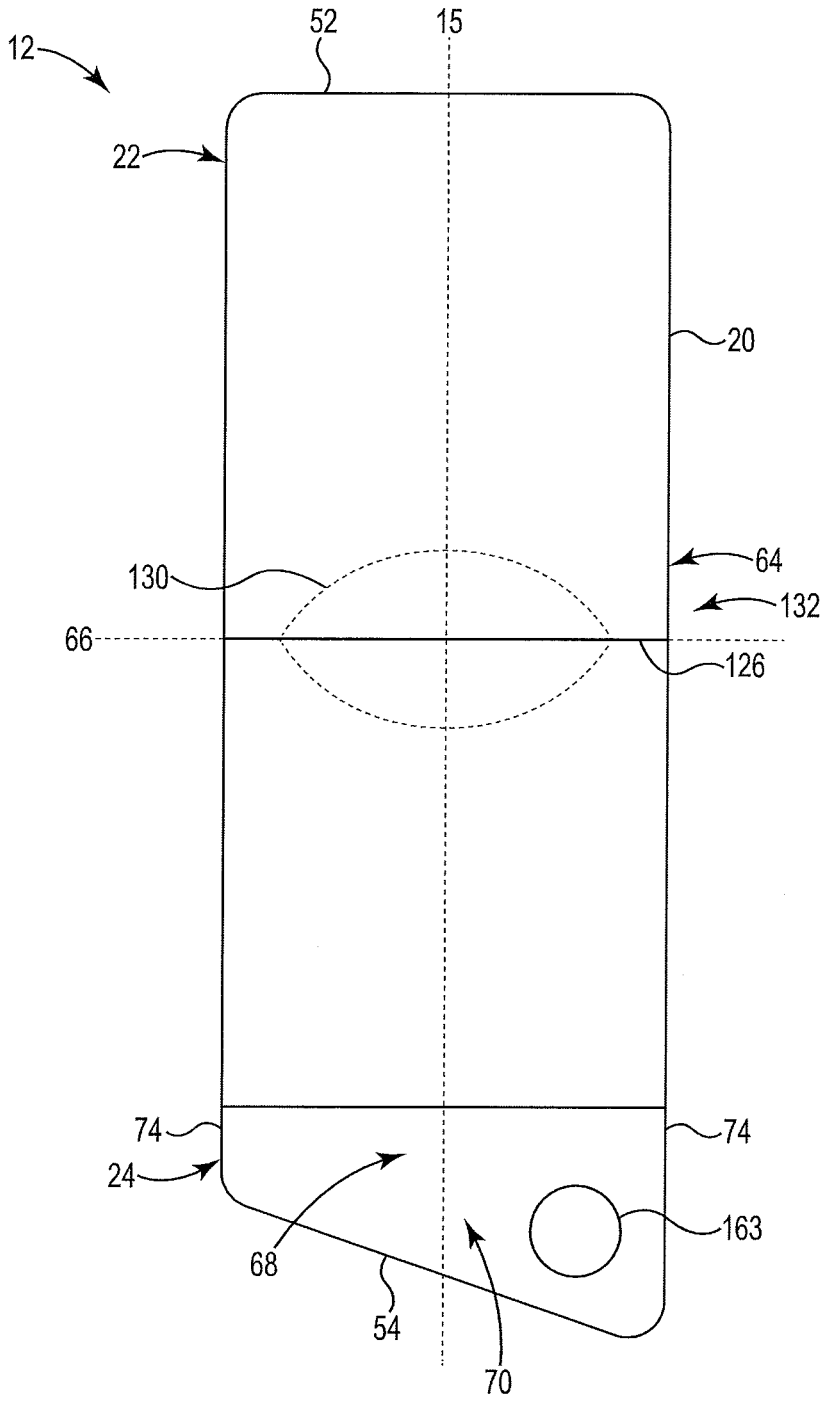
FIG. 11 is a front view of another embodiment of a paint brush package incorporating an alternate fold region in a display state.
Figure 12:
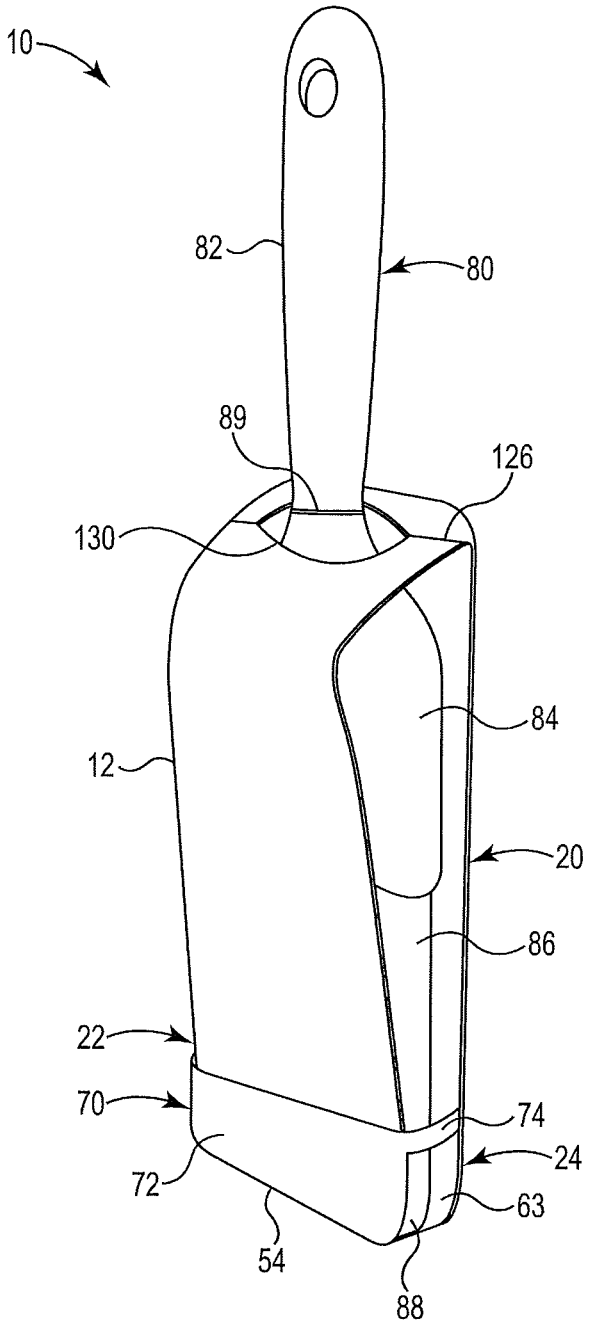
FIG. 12 is a front perspective view of the embodiment of a paint brush inserted into a package of FIG. 11 shown in a protective state.

Referring to FIGS. 11 and 12, in one or more embodiments, for example, the elongate display panel 20 may include one or more variations in the central portion 64 from that shown in FIGS. 1-9. For example, in one or more embodiments, the elongate display panel 20 may have alternate locations for fold lines (e.g., pre-formed hinges) such that the package may be easily converted from a display state to a protective state. For example, in one or more embodiments, for example, the fold region 132 may include a single fold line 126, though any number of folds, including 3 or more could be provided. Single fold line 126 of FIGS. 11 and 12 may pass through the defined region 130, bisecting the region or otherwise intersecting it. In one or more other embodiments, for example, fold line 126 may lie along one edge of the defined region 130, or lie outside the boundary of the defined region 130.

Further, in one or more embodiments, for example, the defined region 130 may be of any shape suitable to accept the handle 82 of brush 80, including a rectangle (with or without rounded edges), a circle, ellipse, triangle, diamond, star, symmetric form, irregular form or any other shape. As an illustration, FIGS. 11 and 12 include an elliptical defined region 130.

Figure 13:
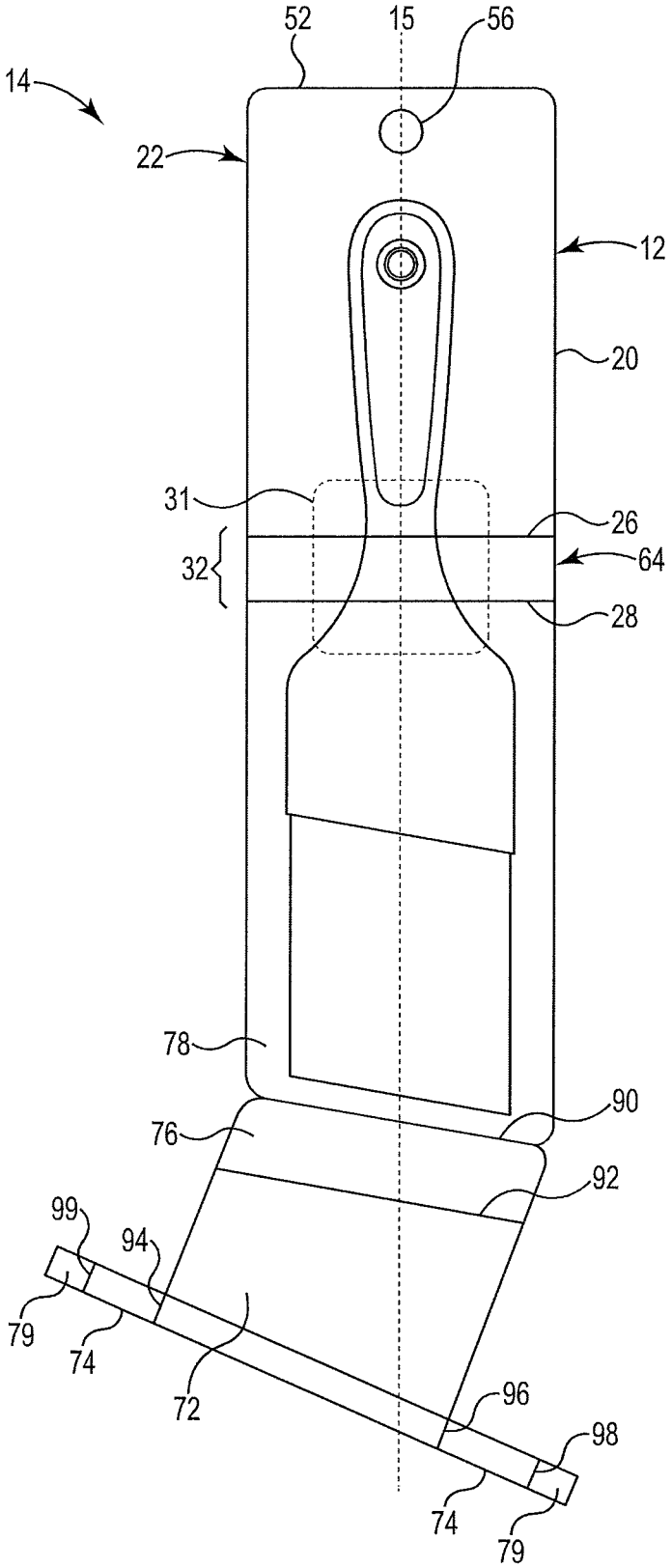
FIG. 13 is a plan view of one exemplary "blank" (e.g., a flat die cut of the package) for providing a package such as shown in FIG. 1.

The package 12 of the packaged paint brush 10 may be made from a blank 14 or any other known method. FIG. 13 is a front view of a blank 14 (e.g., a flat die cut used to provide the package as shown in FIGS. 1-9) in its unfolded or unassembled state. In one exemplary embodiment, the blank 14 may be made using any suitable manufacturing method(s) (e.g., die cutting, laser cutting, water-jet cutting, vibration cutting, scoring, embossing apparatuses, etc.), and using any suitable material(s) (e.g., coated paper, plastics, foils, paper, fabric, cardboard, cardstock, composites, etc.).

In one exemplary embodiment, the elongate display panel 20 may be produced by die cutting a blank from a larger sheet of material and forming the features of the blank 14 as necessary. In some embodiments, the die cutting step (or other manufacturing method) may include creating openings or removable portions where necessary (e.g., removable portions such as one or more defined regions 30, perforations as desired, or optional display mounting element 56). In one or more embodiments, one or more fold lines may be formed (e.g., fold lines 26, 28 may be formed as pre-formed hinges in the central portion 64 of the blank 14). Further, blank 14 may include one or more fold lines for use in providing the receptacle into which the brush tip region 88 is inserted (e.g., receptacle fold lines 90, 92, 94, 96, 98 and 99 for forming the receptacle 62 of the package 12).

In another exemplary embodiment, as shown in FIGS. 16-18, the packaged paint brush 210 may be formed from blank 214 (FIG. 18) and may include elongate display panel 220 including, a first end 252, a first end region 222, a second end 254 and a second end region 224, fold lines 226 and 228, defined region 230, fold region 232.

Blank 214 may further include one or more fold lines for use in providing the receptacle 262 into which the brush tip region 88 is inserted (e.g., receptacle fold lines 290, 292 and 294 for forming the receptacle 262 of the package 212). The receptacle 262 may be formed in the tip holding portion 270 by coupling assembly tab 279 to a rear portion 278 of the tip holding portion using any suitable method (e.g., adhesive, vibration welding, tape, etc.) Blank 214 may further include receptacle opening 263 into which the brush tip region 88 is inserted. Further, as can be seen in FIGS. 16-18, the tip holding portion 270 may be formed by front portion 272, the rear portion 278 and side portions 274). Further, for example, as shown in FIGS. 16-18, the closure apparatus 268 may be provided in the form of the tab 268 (e.g. which may be of any suitable size or shape to attached to the second end region 254) formed or otherwise defined in the first end region 222 of elongate display panel 220 in conjunction with the receiving edge 269 provided at the second end region 224 of the elongate display panel 220 (e.g., and edge of the receptacle 262).

Further, blanks to provide the paint brush packages may be transformed into the packages by any known manufacturing methods and steps suitable for transforming a blank (e.g., such as shown in FIG. 13 or shown in FIG. 18) into a package. In one or more embodiments, additional manufacturing methods could be used. Further, for example, the order of operations (manufacturing and assembly) may vary, the shapes may vary, and their locations may be re-arranged as desired or suitable to provide the desired configuration of a convertible package such as described herein.

Figure 14:
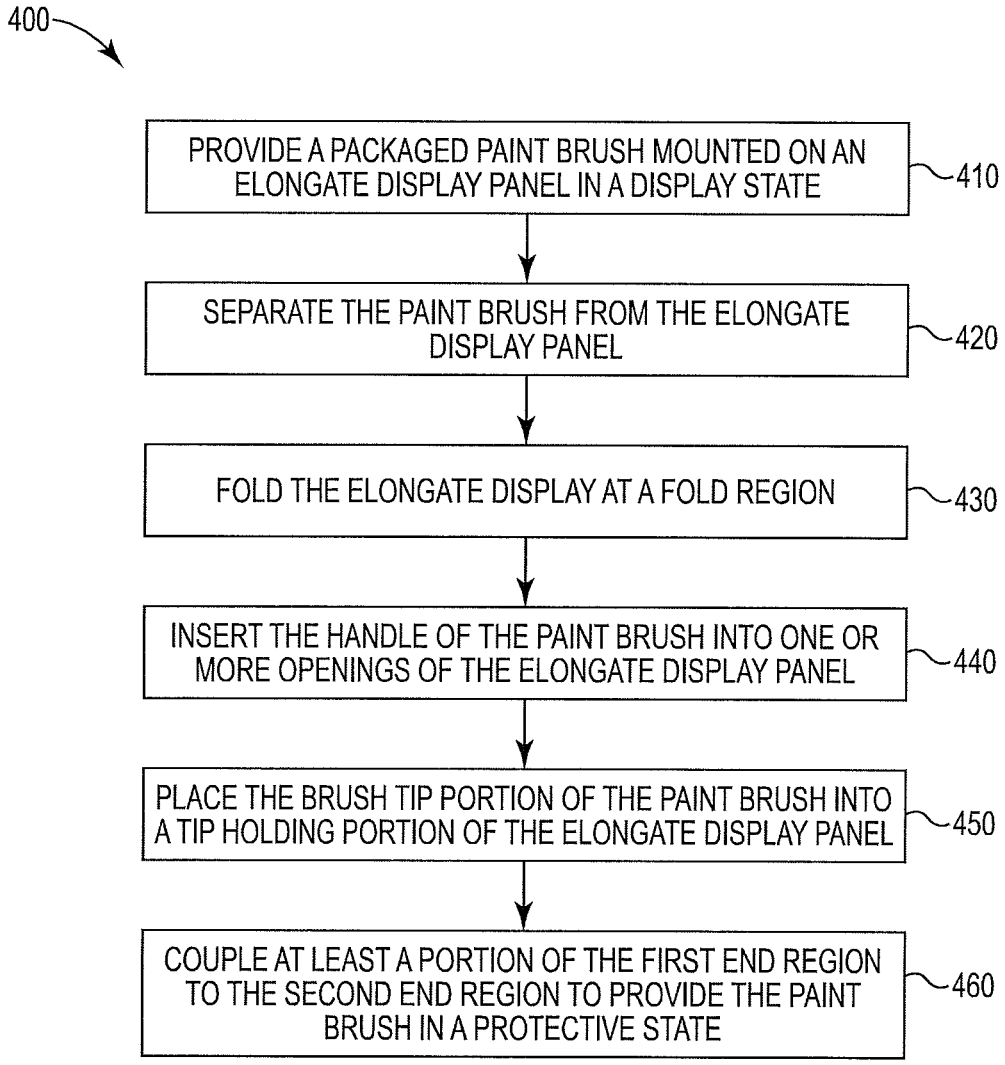
FIG. 14 is one exemplary embodiment of a process flow chart for converting a paint brush package, such as shown in FIG. 1, from a display state to a protective state.

One or more exemplary methods of using a packaged paint brush 10 (such as shown in FIGS. 1-6 and whose reference numbers will be used to describe such a method) shall be described with reference to the process flow diagrams of FIGS. 14 and 15. As shown in FIG. 14, the method 400 may include providing the packaged paint brush 10 (e.g., paint brush 80 mounted on elongate display panel 20). For example, the paint brush 80 may include the handle 82 and the plurality of filaments 86 (e.g., bristles) terminating at the brush tip region 88. The elongate display panel 20 may extend between the first end region 22 and the second end region 24. Further, the elongate display panel 20 may have the paint brush 80 mounted on the elongate display panel 20 in a display state with the handle 82 toward the first end region 22 (block 410) as shown in FIG. 1.

Further, the method 400 may include separating the paint brush 80 from the elongate display panel 20 (block 420). For example, such separation may depend on the fixation elements used to mount the paint brush 80. The elongate display panel 20 may be folded at a fold region 32 (e.g., including fold lines or not including fold lines; instructions being provided concerning where to fold, etc.) located between the first end region 22 and the second end region 24. In one or more embodiments, folding the elongate display panel 20 may include moving at least a portion of the first end region 22 of the elongate display panel 20 towards the second end region 24 of the elongate display panel 20 (block 430).

Further, the method 400 may include inserting the handle 82 of the paint brush 80 into one or more openings 34 of elongate display panel 20 (block 440) and placing the brush tip portion 88 of paint brush 80 into a tip holding portion 70 of the elongate display panel 20 at the second end region 24 of the elongate display panel 20 (block 450). Still further, at least a portion of the first end region 22 is coupled to at least a portion of the second end region 24 of the elongate display panel 20 to provide the paint brush 80 in the protective state (460).

Figure 15:
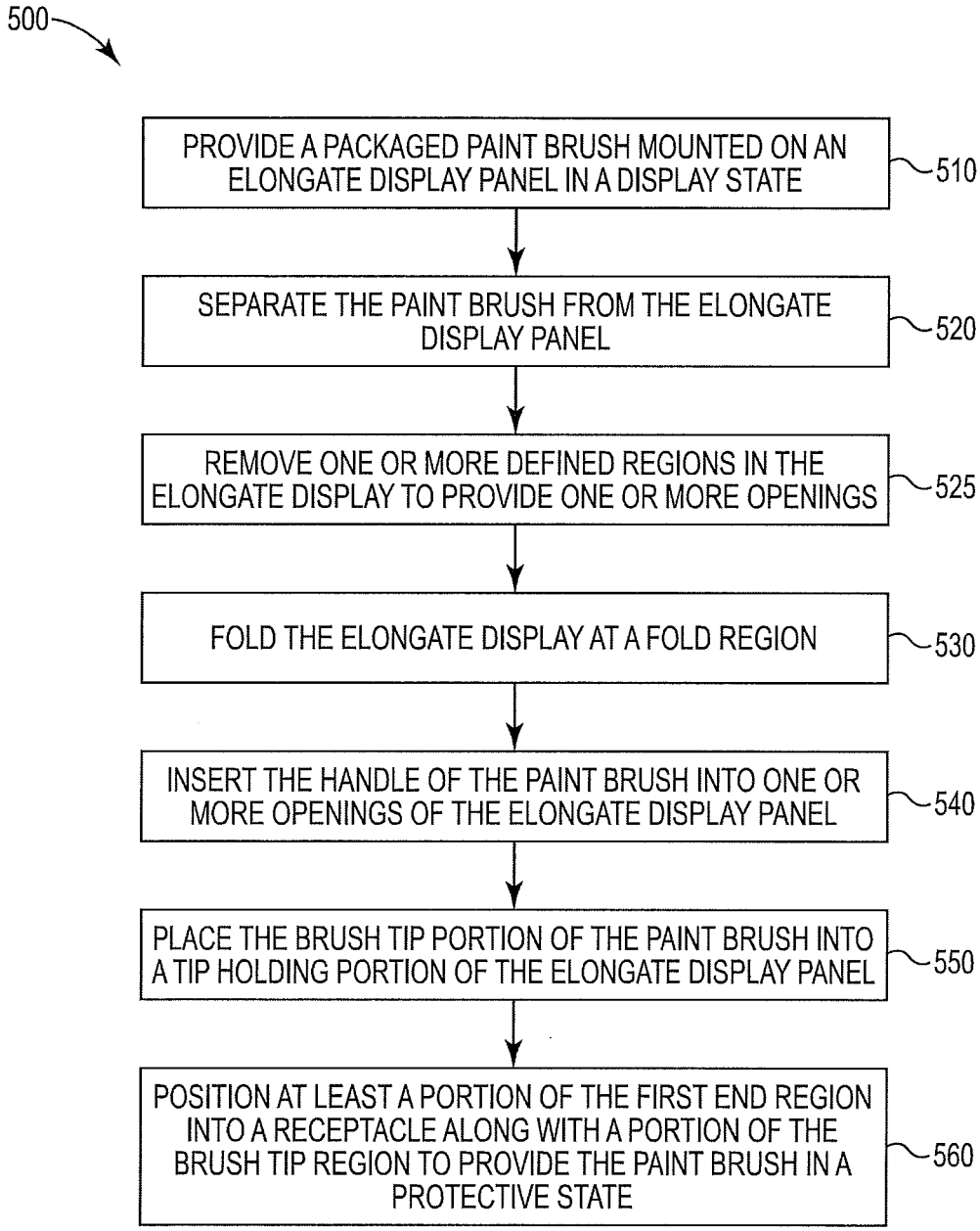
FIG. 15. is another exemplary embodiment of a process flow chart for converting the paint brush package from a display state to a protective state.

FIG. 15 describes another exemplary method of using a packaged paint brush 10. In the method 500 shown in FIG. 15, steps 510, 520, 530, 540 and 550 are substantially the same as steps 410, 420, 430, 440 and 450 (respectively) of the method 400 (shown and described with reference to FIG. 14). In one or more embodiments of the method 500, for example, step 525 may include removing one or more defined regions 30 in the elongate display panel 20 to provide the one or more openings 34 (e.g., removing a perforated region of the display panel 20).

Further, in one or more embodiments of the method 500, step 560 may include coupling at least a portion of the first end region 22 to at least a portion of the second end region 24 may include by positioning a portion of the first end region 22 into the receptacle 62 along with a portion of the brush tip region 88 to provide the paint brush 80 in a protective state.

Illustrative embodiments of this invention are discussed and reference has been made to possible variations within the scope of this invention. These and other variations, combinations, and modifications in the invention will be apparent to those skilled in the art without departing from the scope of the invention, and it should be understood that this invention is not limited to the illustrative embodiments set forth herein. Accordingly, the invention is to be limited only by the claims provided below and equivalents thereof.

What is claimed is:

1. A package apparatus, comprising a convertible package for a paint brush, wherein the paint brush comprises a handle and a plurality of filaments terminating at a brush tip region, the convertible package comprising:

an elongate display panel comprising a front surface extending between a first end region and a second end region terminating opposing ends of the elongate display panel and extending between a first elongate side and a second elongate side of the elongate display panel, wherein the paint brush is mounted adjacent the front surface of the elongate display panel in a display state with the handle of the paint brush adjacent the front surface towards the first end region of the elongate display panel, and further wherein the elongate display panel comprises a tip holding portion at the second end region thereof to cover at least a portion of the plurality of filaments of the brush tip region;

a fold region between the first and second end regions configured to allow the elongate display panel to be folded such that at least a portion of the first end region of the elongate display panel can be coupled near the second end region of the elongate display panel in a protective state to protect the paint brush when the paint brush is removed from a display state mounted on the elongate display panel and then returned to the package to protect at least the brush tip region, wherein the first and second elongate sides lack any panels laterally extending therefrom proximate the fold region; and one or more defined regions corresponding to one or more openings configured to receive therethrough the handle of the paint brush when in the protective state.

2. The package apparatus of claim 1, further comprising the paint brush.

3. The package apparatus of claim 2, further comprising a coupling apparatus to couple the handle to the plurality of filaments, wherein in the display state, at least a portion of the coupling apparatus and at least a portion of the brush tip region are accessible.

4. The package apparatus of claim 2, wherein a length of the elongate display panel from the second end region to a fold line in the fold region of the elongate display panel is configured to be substantially equal to or longer than a length from a handle-brush transition point between the handle and brush of the paint brush to the tip holding portion.

5. The package apparatus of claim 1, wherein the one or more defined regions corresponding to one or more openings configured for receiving a handle of the paint brush comprise at least one defined removable region of the elongate display panel.

6. The package apparatus of claim 1, wherein the one or more defined regions comprise an opening.

7. The package apparatus of claim 1, wherein the fold region is defined in a central portion of the elongate display panel between the first end region and second end region and comprises one or more fold lines substantially orthogonal to an axis defined along a length of the elongate display panel.

8. The package apparatus of claim 7, wherein the one or more defined regions corresponding to the one or more openings configured for receiving a handle of the paint brush are located between a first fold line and a second fold line of the one or more fold lines in the fold region, wherein at least the first and second fold lines are substantially parallel to each other and orthogonal to the axis defined along the length of the elongate display panel.

9. The package apparatus of claim 7, wherein the length from the first end region to the one or more fold lines is substantially equal to the length from second end region to the one or more fold lines.

10. The package apparatus of claim 1, wherein the convertible package further comprises a closure apparatus to couple the first end region near the second end region of the elongate display panel when in the protective state, wherein the closure apparatus comprises at least one of hook and loop fasteners, magnets, tabs/slits, reusable adhesive, and snaps.

11. The package apparatus of claim 1, wherein the second end region is configured to provide a receptacle to receive a portion of the first end region of the elongate display panel in the protective state and to receive the brush tip region of a brush in both the display state and in the protective state.

12. The package apparatus of claim 11, wherein the receptacle comprises one or more access opening to allow access to a portion of the brush tip region when received therein.

13. The package apparatus of claim 1, wherein the elongate display panel is configured such that substantially only the brush tip region of the paint brush is covered by one or more portions of the tip holding portion when mounted in the display state.

14. The package apparatus of claim 1, wherein the convertible package further comprises one or more fixation elements configured to mount a paint brush to the elongate display panel in the display state.

15. The package apparatus of claim 1, wherein the convertible package further comprises a display mounting element associated with the first end region.

* * * * *